US006345689B1

(12) United States Patent
McNamee

(10) Patent No.: US 6,345,689 B1
(45) Date of Patent: Feb. 12, 2002

(54) ROOFTOP FALL PROTECTION SYSTEM

(76) Inventor: Stephen V. McNamee, 17105 27th St. SE., Argusville, ND (US) 58005

( * ) Notice: Subject to any disclaimer, the term of this patent is extended or adjusted under 35 U.S.C. 154(b) by 0 days.

(21) Appl. No.: 09/491,914

(22) Filed: Jan. 27, 2000

(51) Int. Cl.[7] ..... E04G 1/36; A47G 29/02
(52) U.S. Cl. ..... 182/45; 248/237
(58) Field of Search ..... 182/45, 82, 113; 256/65, DIG. 6, 59; 248/148, 237

(56) References Cited

U.S. PATENT DOCUMENTS

| | | | | | |
|---|---|---|---|---|---|
| 852,172 | A | * | 4/1907 | Eschholz et al. | 182/113 X |
| 1,045,840 | A | * | 12/1912 | Hedrick | 182/82 X |
| 3,901,481 | A | | 8/1975 | Probst | 256/59 |
| 4,666,131 | A | | 5/1987 | Kettelkamp, Sr. et al. | 256/59 |
| 4,979,725 | A | | 12/1990 | Hutchings, II et al. | 256/64 |
| 5,067,586 | A | | 11/1991 | Myers | 182/45 |
| 5,353,891 | A | * | 10/1994 | Griek et al. | 182/45 |
| 5,515,941 | A | | 5/1996 | Palmer et al. | 182/45 |
| 5,558,312 | A | * | 9/1996 | Brennan | 182/113 X |
| 5,570,559 | A | | 11/1996 | Lewis | 52/749.2 |
| 5,573,227 | A | | 11/1996 | Hemauer et al. | 256/65 |
| 5,647,451 | A | | 7/1997 | Reichel | 182/45 |
| 5,711,398 | A | | 1/1998 | Bartholomew | 182/45 |
| 6,003,629 | A | * | 12/1999 | Cloutier et al. | 182/45 |
| 6,015,028 | A | * | 1/2000 | Smith | 182/113 X |

FOREIGN PATENT DOCUMENTS

| | | | | |
|---|---|---|---|---|
| GB | 2243397 | * | 10/1991 | 182/45 X |

* cited by examiner

*Primary Examiner*—Daniel P. Stodola
*Assistant Examiner*—Hugh B. Thompson
(74) *Attorney, Agent, or Firm*—Marsh Fischmann & Breyfogal LLP

(57) ABSTRACT

A rooftop fall protection system is disclosed. In one embodiment, the system includes a plurality of at least generally J-shaped stanchions which are attached to the roof. The shorter leg of each stanchion engages the underside of one of the roofing rafters and extends downward lay therefrom, the longer leg of each stanchion is interconnected with the roof's facia board by a facia board mounting clamp and extends upwardly from the roof, while the interconnecting portion between the above-noted legs extends under the facia board. The facia board mounting clamp allows the corresponding stanchion to slide therethrough so as to establish contact with the underside of one of the rafters as noted above. Thereafter, the facia board mounting clamp may be fixed to the corresponding stanchion in an appropriate manner. This allows the stanchion to be used for multiple pitches for roofs. Installation of a plurality of the noted stanchions allows at least one, and preferably a plurality of, cross-members to be mounted on/extend between adjacent stanchions to establish a barrier of sorts.

32 Claims, 7 Drawing Sheets

ROOFTOP FALL PROTECTION SYSTEM

FIELD OF THE INVENTION

The present invention generally relates to the field of fall protection devices which are attached to roofs of building structures and, more particularly, to a more universal fall protection device in relation to any one or more of roof pitch, roof overhang, and facia board height.

BACKGROUND OF THE INVENTION

Construction work can be a very dangerous profession. More and more regulations are being put into effect to address the safety of construction workers. One example is in relation to roofing work where construction workers are installing or repairing a roofing structure. Rooftop fall protection devices which meet certain requirements are now required by OSHA for at least certain types of work being done on at least certain types of roofs.

Various rooftop fall protection devices have been proposed in the past. Few if any have met with any degree of commercial success. There are numerous contributing factors. One is the complexity of many of the rooftop fall protection devices. Complex designs mean increased manufacturing costs which are of course passed on to the contractor. Contractors will often have a number of roofing jobs going on at the same time which increases the number of fall protection devices which the contractor must purchase. Many contractors simply cannot afford to maintain an adequate inventory of fall protection devices such that the use of fall protection devices becomes cost prohibitive. Increased complexity of the design of the fall protection device also usually means a large number of parts. As the number of parts increases, so to does the likelihood that one or more of these parts will be lost or misplaced. Lost or misplaced parts may render the fall protection device unusable or unsafe if installed, both of which defeats the purpose of the above-noted regulations.

Installation may also may become an issue if complex designs are implemented in a given rooftop fall protection device. Certain complexly designed fall protection devices may be time consuming to install. Either the construction job will become more expensive or the installation will be done in haste which increases the likelihood of an improper and thereby unsafe installation. Some rooftop fall protection device designs may be so complex that they would require a contractor to spend adequate time, and therefore money, on training personnel on the proper installation and/or use of the fall protection device. This is somewhat unrealistic due to the often transient nature of construction crews where individual crew members often come and go. Without proper training and if the design is complex, the rooftop fall protection device will often be left on the ground or it will be improperly installed. All of these scenarios are undesirable.

Another factor which has likely adversely affected the commercial success of rooftop fall protection systems is the lack of uniformity in rooftop construction. More and more different pitches are being used in current construction projects. Many fall protection devices are designed for use with only a single roof pitch, which means that the contractor would be required to further increase the inventory of rooftop fall protection devices. Those rooftop fall protection devices that may be used on multiple roof pitches likely utilize a complex design. Both of these factors introduce the above-noted types of drawbacks.

Finally, many rooftop fall protection devices simply are not practical for the type of work which must be done on the roof. Any rooftop fall protection device which is disposed on the roofing surface or on the surface on which the roof is to be installed limits the instances in which the device may be used. Consider a situation where the rooftop fall protection device is designed to attach to a deck (e.g., plywood nailed onto the upper surfaces of the roofing rafters). This means that up until the time that the deck is installed, the fall protection device would be unusable. Relatively significant safety issues exist in roofing applications up to the time that the deck is installed. Having the fall protection device installed on the deck or other roofing surface also limits the amount of the roof which may be worked on with the fall protection device installed. How is that portion of the roof between the fall protection device and the edge of the roof to be worked upon? These are just some of the impracticalities associated with some rooftop fall protection device designs which have been proposed.

FIG. 1 presents a rooftop fall protection system 70 which is admitted to be in the prior art and which is installed on a roof 5. Generally, the roof 5 includes a plurality of laterally-spaced rafters 10 (only one shown). One characteristic of the roof 5 relates to the orientation of the rafters 10. Each rafter 10 is disposed at a first angle 65 relative to a horizontal reference plane and which is effectively tantamount to the pitch of the roof 5. Another characteristic of the roof 5 is its overhang which is that portion of the roof 5 which extends beyond a vertically-disposed wall (not shown) which supports the roof 5.

Each rafter 10 includes a first rafter end 15 which is fixed to an at least generally horizontally disposed facia board 40. The rafters 10 extend from this facia board 40 to a peak associated with the roof 5 along a generally longitudinally or axially extending path. Each rafter 10 further includes a first rafter edge surface 25 ("top" surface), a vertically spaced second rafter edge surface 30 ("bottom" surface), and a pair of laterally spaced rafter side surfaces 35. Roofing materials are installed on the first rafter edge surface 25. The rafters 10 are thereby disposed "on edge" in the installed position. That is, the distance between the first rafter edge surface 25 and the second rafter edge surface 30 is typically greater than the distance between the pair of rafters side surfaces 35. Typical dimensions used for the rafters 10 include 2×4s. Other dimensions for rafters 10 have been used.

The facia board 40 extends along the edge of the roof 5 and is attached to each of the rafters 10 which interfaces therewith such as by nails or the like. More specifically, the facia board 40 includes a first facia board side surface 45 which projects at least generally away from the roof 5, a second facia board side surface 50 which interfaces with the rafters 10, a first facia board edge surface 55 which projects at least generally "upwardly", and a vertically spaced second facia board edge surface 60 which projects at least generally "downwardly." The facia board 40 is thereby disposed "on edge" in the installed position. That is, the distance between the first facia board edge surface 55 and the second facia board edge surface 60 is typically greater than the distance between the first facia board side surface 45 and the second facia board side surface 50. Various dimensions are now being used for the facia boards 40, including 2×4s, 2×6s, 2×10s, and 2×12s.

The fall protection system 70 is installed on the roof 5 to protect workers from falling off the same. One component of the fall protection system 70 is a plurality of stanchions 75 which are spaced along the facia board 40 (only one shown in FIG. 1). Each stanchion 75 is defined by a first stanchion section 80 which is at least generally longitudinally extending and vertically disposed when mounted on the particular roof 5 of FIG. 1, and a second stanchion section 85 which is also least generally longitudinally extending and horizontally disposed when mounted on the particular roof 5 of FIG. 1. As such, the stanchions 75 utilize an L-shaped profile. The stanchions 75 are of an integral structure such that there is no mechanical joint between the first stanchion section 80 and the second stanchion section 85. This integral structure with the noted profile is formed by a bending operation. Another key component of the fall protection system 70 is a plurality of vertically spaced cross-members 92 which extend between at least two of the stanchions 75. In this regard, each stanchion 75 includes a plurality of cross-member brackets 90 which define a pocket in which a given cross-member 92 may be disposed.

Two points of interconnection exist between each stanchion 75 and the roof 5. One is on the facia board 40 and another is on one of the rafter side surfaces 35 of one of the rafters 10. In this regard, each stanchion 75 includes a facia board mounting bracket 95 which is fixed to the second stanchion section 85 (e.g., via welding) and through which an appropriate fastener 105 (e.g., screw) extends into the facia board 40. Each stanchion 75 further includes a rafter mounting bracket 100 which is also fixed to the second stanchion section 85 (e.g., via welding) and to which an appropriate fastener 105 extends into the corresponding rafter 10 through one of its rafter side surfaces 35.

There are a number of key limitations regarding the fall protection system 70 of FIG. 1. One is that the fall protection system 70 was designed for use with a facia board 40 of only one height, or a facia board 40 having only a certain distance between the first facia board edge surface 55 and the second facia board edge surface 60. There is a fixed positional relationship between the facia board mounting bracket 95 and the remainder of the stanchion 75. If a facia board 40 having a height greater than that illustrated in FIG. 1 is used, and if the stanchion 75 is to be retained in the illustrated position with the first stanchion section 80 being disposed perpendicular to the horizontal, the rafter mounting bracket 100 would be too short and could not be properly fixed to the rafter 10. Another key limitation regarding the fall protection system 70 is that it is designed for use with effectively only a single pitch for a roof 5 due to the fixed positional relationship between the rafter mounting bracket 100 and the remainder of the stanchion 75, and further between the facia board mounting bracket 95 and the remainder of the stanchion 75. If the pitch of the roof 5 varied significantly from that illustrated in FIG. 1, and if the stanchion 75 is to be retained in the illustrated position with the first stanchion section 80 being disposed perpendicular to the horizontal, the hole through the rafter mounting bracket 100 may be disposed too close to one of the rafter edge surfaces 25, 30 to provide for a safe installation, or may miss the rafter 10 entirely such that the bracket 100 could not even be attached thereto. In the event that the fall protection system 70 was installed on a roof having a pitch different than that illustrated in FIG. 1 and the stanchion 75 was pivoted relative to the facia board 40 so as to allow the hole through the rafter mounting bracket 100 to be aligned with the rafter 10 at an appropriate location on the rafter, the first stanchion section 80 of the stanchion 75 would no longer be vertically disposed. Moreover, there would not be an abutting relation between the facia board mounting bracket 95 and the facia board 40, or between the rafter mounting bracket 100 and the rafter 10. This all may reduce the effectiveness of the fall protection system 70 in retarding the movement of a worker falling down the roof 5.

BRIEF SUMMARY OF THE INVENTION

The present invention relates to fall protection devices which are attachable to a roof. One roof design on which fall protection devices in accordance with the principles of the present invention may be installed/used includes a facia board and a plurality of rafters. The facia board defines the edge of the roof in that the noted rafters are attached thereto and extend upwardly and away therefrom, such as toward a peak associated with the roof. The facia board includes first and second facia board side surfaces. Typically the first and second facia board side surfaces will be substantially parallel to each other and disposed in an at least substantially vertical orientation when installed on the roof (i.e., perpendicular to a horizontal reference plane). Although facia boards of differing dimensions are now commonly being used in residential construction, one common facia board is a 2×6. In this case the noted first and second facia side surfaces would correspond with surface defined by the 6 inch (actually 5.5 inches) dimension and the length of the facia board, such that the facia board would be installed "on edge" on the roof (i.e., with the two inch (actually 1.5 inch) dimension defining the thickness of the facia board).

The plurality of rafters are defined herein as extending upwardly and away from the second facia board side surface at a first angle relative to a horizontal reference plane (i.e., relating to/defining a pitch associated with the roof, which may include more than pitch). These rafters are further defined as including a first rafter edge surface on which roofing materials may be installed (e.g., a plywood deck, shingles) and a second rafter edge surface which is opposite the first rafter edge surface (e.g., "underneath" the roof). Although rafters of differing dimensions may be used in roofing applications, one common roofing rafter is a 2×4. In this case the first and second rafter edge surfaces would correspond with the surface defined by the 2 inch (actually 1.5) dimension and the length of the rafter, such that the rafter would be installed "on edge" on the roof (i.e., with the two inch (actually 1.5 inch) dimension defining the height of the rafter). Typically the end of the rafter which interfaces with the facia board is cut at an angle other than perpendicular to the edge surfaces of the rafter so as to dispose the facia board in the above-noted at least substantially vertical orientation on the roof.

A first aspect of the present invention is embodied in a rooftop fall protection system which includes at least one stanchion. Typically a plurality of these stanchions will be installed along spaced locations on the edge of the roof. At least one, and typically a plurality of, cross-members will extend between and be supported by at least adjacent stanchions to define a barrier of sorts along the edge of the roof which is under construction or repair. How these stanchions are attached to and interface with the roof is effectively the subject of this first aspect of the present invention. In this regard, the subject stanchion includes structure for fixing the stanchion to the first facia board side surface, or that surface of the facia board which is opposite that from which the rafters extend away from the facia board. The subject stanchion further includes means for engaging the second rafter edge surface of one of the plurality of rafters, or that surface of the rafter which is opposite that from which roofing materials are typically installed on the rafters. Preferably these are the only two points of contact between the stanchion and the roof for purposes of "supporting" the fall protection system on the roof. As such, the fall protection system in accordance with this first aspect of the present invention does not impair the ability of the construction workers to work on the entirety of the roofing surface.

Various refinements exist in relation to the above-noted features of the subject first aspect of the present invention.

Further features may also be incorporated in the subject first aspect of the present invention as well. These refinements and additional features may exist individually or in any combination. The structure for fixing the stanchion to the first facia board side surface may include a mounting bracket. This mounting bracket in turn may include an at least substantially U-shaped section through which a vertically extending portion of the stanchion slidably extends. Collapsing or drawing in the open portion of this U-shaped section may be used to clamp the mounting bracket about the stanchion and maintain such in a fixed position relative to the mounting bracket. Another portion of the mounting bracket may be disposed to interface with the first facia board surface and may include at least one aperture to direct an appropriate fastener therethrough and into the facia board. Preferably this latter portion of the mounting bracket is a substantially planar surface to provide an appropriate interface with the first facia board side surface. Moreover, preferably the mounting bracket extends away from the first facia board side surface a certain distance such that when one of the cross-members is mounted on an adjacent stanchion, an edge thereof will be disposed on or substantially proximate to and uppermost surface of the facia board (e.g., to define a toe board of sorts to reduce the potential for materials sliding down and off the roof). Other types of facia board mounting brackets which include a collar or the like through which the stanchion may slidable extend may be used. Moreover, the position of the stanchion relative to the facia board mounting bracket may be maintained in other manners, such as by the use of one or more set screws or the like.

The structure for engaging the second rafter edge surface of one of the plurality of rafters may be realized through a configuration of the stanchion which directs the stanchion under the facia board and then upwardly into engagement with the second rafter edge surface of one of the rafters. With the stanchion being fixed to the facia board in the above-noted manner and if a force is exerted on that portion of the stanchion which is extending upwardly and away from the roof, the stanchion will exert a compressive force on its associated rafter which makes for a firm interconnection between the stanchion and the roof. A rafter mounting bracket may be provided on the stanchion to reduce the potential for the stanchion being twisted away from a position where it no longer engages the second rafter edge surface of its associated rafter. A suitable fastener (e.g., screw, threaded bolt) may extend through this rafter mounting bracket and into the corresponding rafter (therethrough in the case of the threaded bolt such that a nut could be disposed on the opposite side of the rafter) to positionally fix the stanchion relative to the rafter.

As noted, the stanchion may be configured such that it engages the second rafter edge surface (again, the surface of the rafter opposite that on which roofing materials are typically installed). One configuration of a stanchion which would provide this function is a stanchion which is at least generally J-shaped. Another way of describing this type of stanchion would be a stanchion having first, second, and third stanchion sections, having first and second free ends, and having the second stanchion section being at least generally semi circular or at to define a generally concave shape for the lower portion of the stanchion to go "down and around" the facia board. In this regard, the first stanchion section would extend away from the first free end at least generally in a first direction (e.g., downwardly) to one side of the second stanchion section, the second stanchion section would extend underneath the facia board, and the third stanchion section would extend from the other side of the second stanchion section in a second direction (e.g., upwardly) to the second free end for engagement with the second rafter edge surface. It need not be a "free end" of the stanchion that engages the second rafter edge surface, but instead could be any portion of the stanchion or structure interconnected therewith. For instance, a "bend" could be formed in the third stanchion section which actually engaged the second rafter edge surface or a generally u-shaped bracket could be incorporated into the structure of the stanchion to engage the second rafter edge surface and at least a portion of the rafter side surfaces of a short segment of the subject rafter. Although the stanchion is described as being multi-sectional, preferably it is of integral (i.e., one piece) construction such that there are no joints between the first and second stanchion sections or between the second and third stanchion sections.

In one embodiment, the stanchion may be formed from a piece of square tubing and may be bent into the above-noted profile. Further increases to the strength of the stanchion may be affected by forming a radius on an upper and lower surface of the square tube which will define the surface of the second stanchion section which projects toward the undersurface of the facia board and the surface of the second stanchion section which projects away from the undersurface of the facia board, respectively. These radii may extend toward each other to define opposing concavities for the "upper" and "lower" surfaces of the second stanchion section.

The stanchion of the subject first aspect of the present invention may be configured to work with any roof pitch, with any overhang of 5 inches or more (5 inch overhangs are typically the minimum, with the overhang being the distance of the facia board from the adjacentmost wall which supports the roof and as measured along the horizontal), or both, all while maintaining the portion of the stanchion which supports the cross-members in a vertical position or perpendicularly to a horizontal reference plane. Consider the situation where the stanchion is defined by an at least generally J-shaped structure and where the stanchion includes a facia board mounting bracket which may be fixed to the first facia board side surface and which has an aperture through which the longer leg of the J-shaped stanchion may slidably extend. By allowing the longer leg of the J-shaped stanchion to slide through this aperture in the mounting bracket until the shorter leg of the "J" engages the second rafter edge surface of one of the rafters, and by thereafter allowing the stanchion to be secured to or maintained in a fixed position relative to the mounting bracket (e.g., via the above-noted clamping-like action), it can be seen that the stanchion of the subject first aspect may be used with any roof pitch. At most a change in pitch of the roof will only change the distance which the longer leg of the "J" extends vertically beyond the uppermost surface of the facia board. Selecting an appropriate radius for the arcuate portion of the J-shaped structure of the stanchion in the above-described configuration, or the distance between the first and second stanchion sections, further facilitates the use of the stanchion with any roof pitch, as well as having a third stanchion section of suitable length. However, this also allows the stanchion to be used on roofs having different facia board heights (the vertical dimension of the facia board), different overhang widths, or both. In one embodiment, the radius of the arcuate portion of the noted J-shaped structure is about 3.75 inches, which allows the stanchion to be used on any roof having an overhang of at least 5 inches.

DETAILED DESCRIPTION OF THE INVENTION

Figure 1:
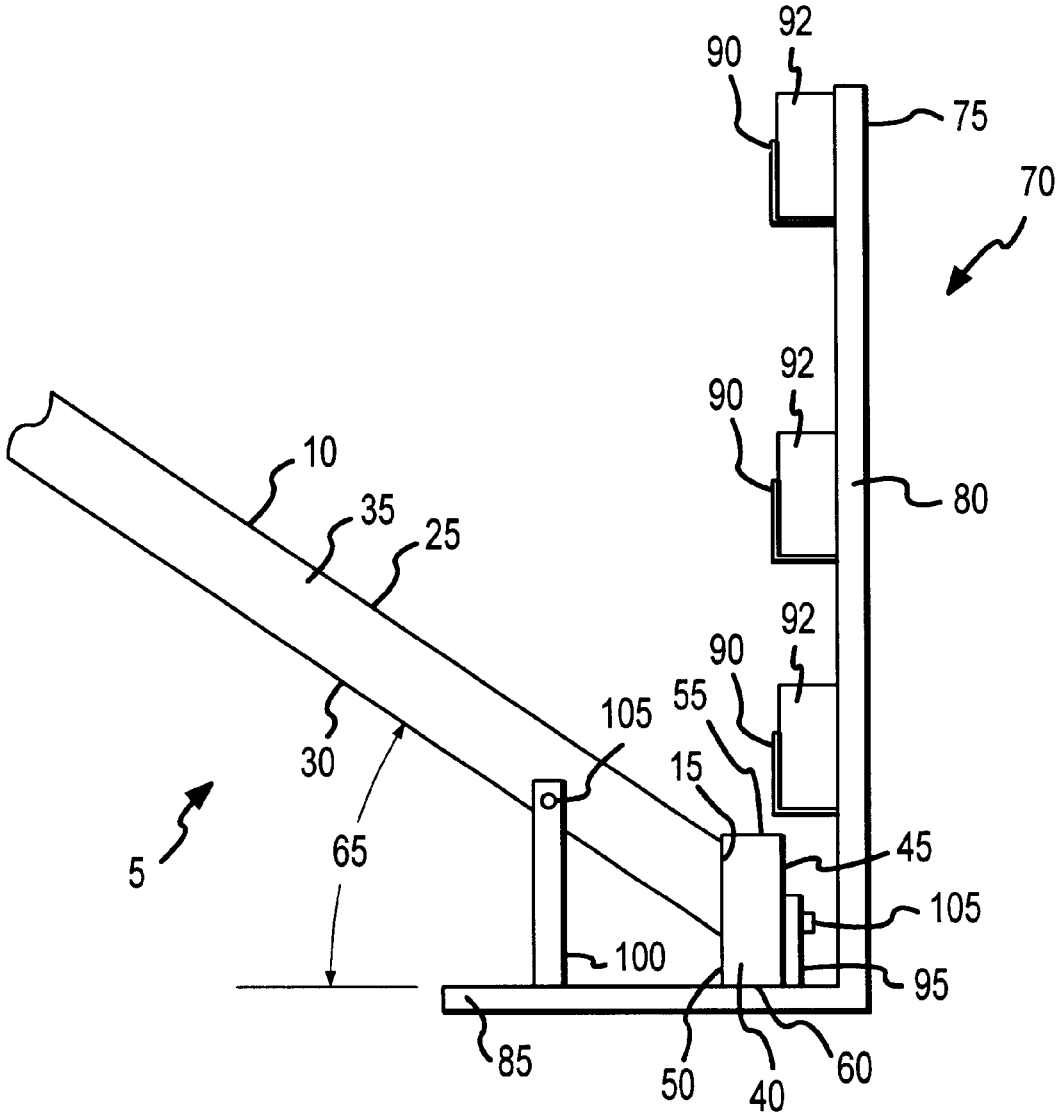
PRIOR ART FIG.1
FIG. 1 is an end view of a prior art rooftop fall protection system.
Figure 2:
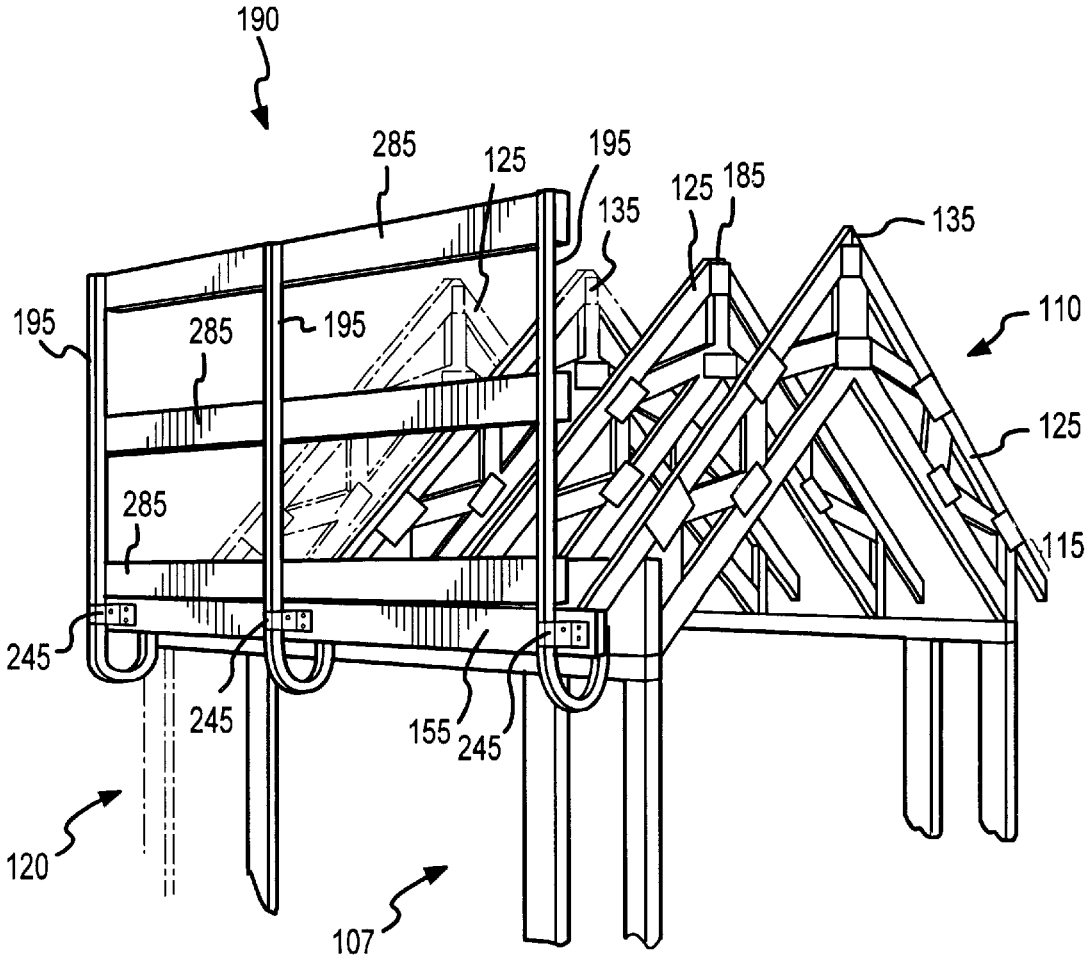
FIG. 2 is a perspective view of a rooftop fall protection system in accordance with principles of the present invention as installed on a roof of an exemplary building.
Figure 3:
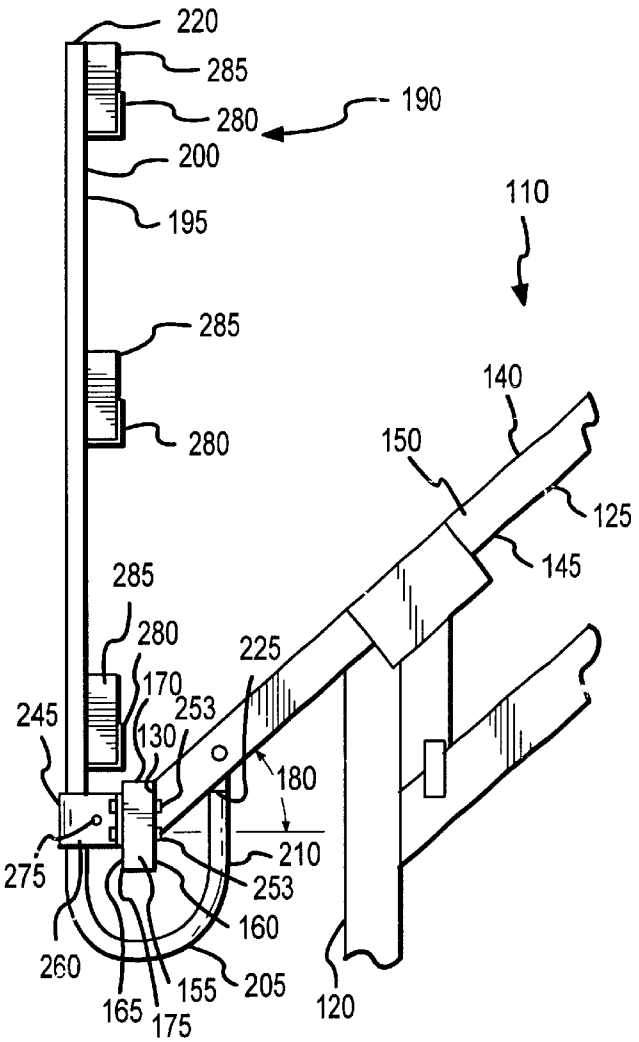
FIG. 3 is a view of one end of one of the stanchions of the fall protection system illustrated in FIG. 2.
Figure 4:
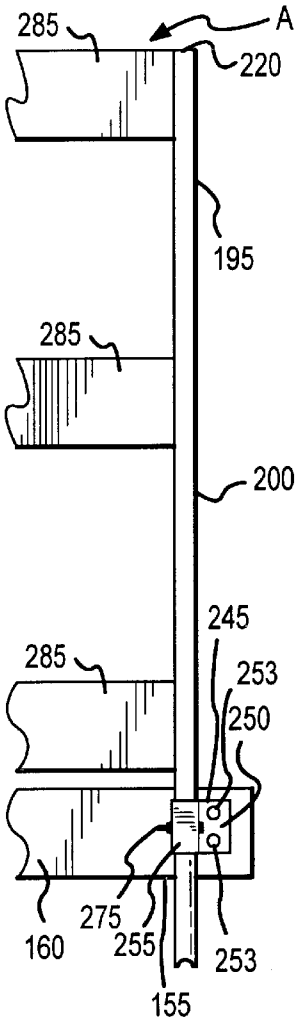
FIG. 4 is a front view of the stanchion illustrated in FIG. 2.
Figure 5:
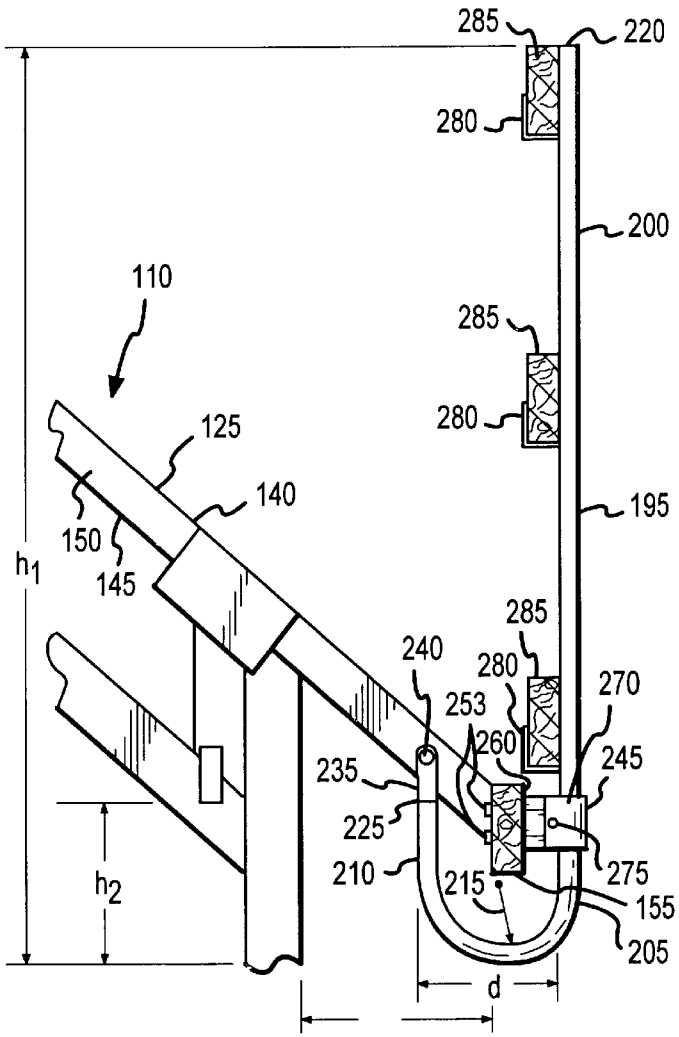
FIG. 5 is a view of the other end of the stanchion illustrated in FIG. 2.

The present invention will be described in relation to the accompanying drawings which assist in illustrating its various pertinent features. FIGS. 2–5 present one embodiment of a rooftop fall protection system 190 in accordance with principles of the present invention. The fall protection system 190 is mounted on a particular roof 110 of a building structure 107. Generally, the roof 110 includes a plurality of laterally-spaced rafters 125. One general characteristic of the roof 110 relates to the orientation of the rafters 125. Each rafter 125 is disposed at a first angle 180 relative to a horizontal reference plane and which is effectively tantamount to the pitch of the roof 110. More than one pitch may exist on any one roof design. Another general characteristic of the roof 110 is its overhang 115 which is that portion of the roof 110 which extends beyond a vertically-disposed wall 120 which supports the roof 110 and which is typically measured along the horizontal. As will be discussed in more detail below, the fall protection system 190 works with a large range of pitches for the roof 110 and with any overhang 115 which is at least five inches in width.

Each rafter 125 includes a first rafter end 130 which is fixed to an at least generally horizontally disposed facia board 155 which extends along and more accurately defines an edge of the roof 110. Opposite the first rafter end 130 is a longitudinally displaced second rafter end 135 which will typically be disposed at a peak 185 associated with the roof 110. More than one peak 185 may exist on a given roof 110. Each rafter 125 further includes a first rafter edge surface 140, a vertically spaced second rafter edge surface 145, and a pair of laterally spaced rafter side surfaces 150. Roofing materials are installed on the first rafter edge surface 140. The rafters 125 are thereby disposed "on edge" in the installed position. That is, the distance between the first rafter edge surface 140 and the second rafter edge surface 145 is typically greater than the distance between the pair of rafter side surfaces 150. Typical dimensions used for the rafters 125 include 2×4s. The fall protection system 190 may be used on rafters 125 of any dimension, however.

The facia board 155 extends along the edge of the roof 110 and is attached to each of the rafters 125 which interfaces therewith such as by nails, screws, or any other appropriate fastener/fastening mechanism. More specifically, the facia board 155 includes a first facia board side surface 160 which projects at least generally away from the roof 110, a second facia board side surface 165 which interfaces with the rafters 125 or more specifically the first rafter ends 130 (e.g., via a butt joint), a first facia board edge surface 170 which projects at least generally "upwardly", and a vertically spaced second facia board edge surface 175 which projects at least generally "downwardly." The facia board 155 is thereby disposed "on edge" in the installed position. That is, the distance between the first facia board edge surface 170 and the second facia board edge surface 175 is typically greater than the distance between the first facia board side surface 160 and the second facia board side surface 165. As will be discussed in more detail below, the fall protection system 190 accommodates the use of a relatively large range of dimensions for the facia board 155, particularly in relation to the distance between the first facia board edge surface 170 and the second facia board edge surface 175 which will hereafter be referred to as the "height" of the facia board 155.

The fall protection system 190 functions to reduce the potential for injury to personnel working on the roof 110 by at least reducing the potential for these personnel falling off of the roof 110. One principal component of the fall protection system 190 are a plurality of similarly configured stanchions 195 which are installed at spaced locations along the facia board 155. Because of the configuration of the stanchions 195 and the manner in which the same interfaces with the roof 110 and for a stanchion 195 within the above-noted dimensions, the fall protection system 190 may be used on the roof 110 having a pitch which is within a range of about 0 (i.e., flat) to about 12, may be used on any overhang 115 which is at least about five inches in width (the distance from the wall 120 to the first facia board side surface 160 along a line which is at least generally horizontally disposed or perpendicular to the wall 120), and with a facia board 155 having a height (i.e., the distance between the first facia board edge surface 170 and the second facia board edge surface 175) of up to about 10 inches, all while maintaining the stanchions 195 in the same orientation in each of these cases (e.g., with the first stanchion sections 200 being in the same at least substantially vertical orientation in each of these cases). As such, the stanchions 190 significantly increase the versatility of the fall protection system 190 in relation to prior art rooftop fall protection devices, all while providing a structurally stable barrier to at least impede, and more preferably to terminate, a workers descent down the pitch of the roof 110.

Each stanchion 195 is of an at least generally J-shaped configuration and may be characterized as including first, second, and third stanchion sections 200, 205, and 210, respectively. A first stanchion end 220 defines the uppermost extreme of a given stanchion 195. Extending at least generally downwardly from this first stanchion end 220 along an at least generally longitudinally or axially extending path is the first stanchion section 200. The second stanchion section 205 directs the stanchion 195 under the facia board 155 (at a lower elevation than the second facia board edge surface 175), while the third stanchion section 210 proceeds back up toward the associated rafter 125 to a second stanchion end 225 which engages the second rafter edge surface 145 of this rafter 125. In the illustrated embodiment the second stanchion section 205 is of a generally semi-circular configuration as defined by a radius 215. In one embodiment, the radius 215 is within the range from about 3.75 inches to about 5.25 inches, and is more preferably about 4.5 inches (measured to the centerline of the stanchion 195) so as to direct the stanchion 195 under the facia board 155 and allow the stanchion 195 to engage the second rafter edge surface 145. Stated another way, the first stanchion section 200 and the third stanchion section 210 are separated by a distance "d." In one embodiment, the distance "d" is within the range from about 7.5 inches to about 10.5 inches, and is more preferably about 9 inches so as to direct the stanchion 195 under the facia board 155 and allow the stanchion 195 to engage the second rafter edge surface 145. This relative positioning of sorts of components of the stanchion 195 allows the stanchion 195 to be used on any roof 110 having an overhang 115 which is at least about 5 inches. If the ability to use on virtually any overhang would not be a concern, the first stanchion section 200 and the third stanchion section 210 could be separated by any suitable distance.

In the illustrated embodiment, the first stanchion section 200 and third stanchion section 210 are disposed in at least substantially parallel relation, although such is not required. However, the first stanchion section 200 and third stanchion section 210 are of different lengths, with the third stanchion section 210 being shorter than the first stanchion section 200. As such, the second stanchion end 225 is disposed at a lower elevation than the first stanchion end 220. In one embodiment, the length of the first stanchion section 200 is within a range of about 54 inches to about 56 inches, while the length of the third stanchion section 210 is within a range of about 9 inches to about 11 inches. Stated another way, the first stanchion end 220 is disposed a distance $h_1$ above the lower extreme of the stanchion 195, while the second stanchion end 225 (which contacts the second rafter edge surface 145) is disposed a distance $h_2$ above this same lower extreme. In one embodiment, the distance $h_1$ is within a range of about 54 inches to about 56 inches. In one embodiment, the distance $h_2$ is within a range of about 9 inches to about 11 inches. Preferably, the first stanchion end 220 is disposed at least about 39 inches above the first facia board edge surface 170.

There are three points of contact between each stanchion 195 and the roof 110, although only two of such points are for purposes of "supporting" the fall protection system 190 on the roof 110. Each stanchion 195 is attached to the facia board 155 via a facia board mounting bracket 245 by at least one, and preferably a plurality of, suitable fasteners 253. Although nails, screws, or the like could be utilized, preferably each stanchion 195 is attached to the facia board 155 by a plurality of threaded bolts which extend through the facia board mounting bracket 245 and facia board 155, such that a nut may be threaded onto the end of the bolt to compressively retain the facia board mounting bracket 245 on the facia board 155.

Another point of contact between each stanchion 195 and the roof 110 is via the second stanchion end 225 which is disposed "under" one of the rafters 125, or more specifically against the second rafter edge surface 145. With each stanchion 195 being pinned to the roof 110 at the facia board 155, the exertion of an outwardly directed force on the stanchion 195, or in the direction of the arrow "A" presented in FIG. 3, will cause the stanchion 195 to attempt to pivot in the same direction. This would be the type of force exerted on the fall protection system 190 in a fall-type situation. The interface between the second stanchion end 225 and the second rafter edge surface 145 resists the noted pivoting-like motion of the stanchion 195 to securely retain the stanchion 195 on the roof 110. However, in order to reduce the potential for the second stanchion end 225 losing contact with the second rafter edge surface 145 and thereby providing the desired resistance to the noted pivoting of the stanchion 195, a rafter mounting bracket 235 is appropriately attached to the third stanchion section 210. At least one hole extends through the rafter mounting bracket 235 such that an appropriate fastener(s) 240 may be directed therethrough and into the corresponding rafter 125 at one of its rafter side surfaces 150. Although nails, screws, or the like could be used for the fastener 240, once again the preferred fastener 240 is a bolt which extends through the rafter mounting bracket 235 and all the way through the rafter 125 (from one rafter side surface 150 to the opposing rafter side surface 150) such that a nut may be disposed on a threaded portion thereof to compressively retain the rafter mounting bracket 235 on the subject rafter 125. It should be appreciated that the interconnection between the stanchions 195 and their corresponding rafter 125 via the rafter mounting bracket 235 is not purely a load-bearing interconnection, but one which is more for retaining the stanchion 195 in a certain fixed positional relationship relative to the corresponding rafter 125 (i.e., to keep the stanchion 195 from "twisting off" from engagement with the second rafter edge surface 145).

Another key component of the fall protection system 190 are a plurality of cross-members 285 which extend between adjacent stanchions 195 when mounted on the roof 110. Each cross-member 285 extends between at least two stanchions 190, although each cross-member 285 may extend the entire length of the fall protection system 190. Interconnection between the cross-members 285 and the stanchions 190 is through a plurality of at least generally cup-shaped cross-member brackets or mounts 280 which are appropriately attached to (e.g., welded) and vertically spaced along the first stanchion section 200. Three such brackets 280 are provided for each stanchion 195 in the illustrated embodiment, although different numbers of brackets 280 could be utilized, as well as different configurations. Preferably there is no more than about a 20 inch spacing between adjacent brackets 280 on a given stanchion 190. Moreover, preferably one of the cross-member brackets 280 is disposed on a lower portion of the first stanchion section 200 so as to dispose one of the cross-members 285 at least substantially proximate to the facia board 155. Preferably, there is no more than about a 0.25 inch spacing between the lowermost cross-member 285 and the facia board 155. Moreover, preferably the upwardly-extending portion of the cross-member brackets 280 is disposed in at least substantially parallel relation to the first facia board side surface 160 and is disposed only slightly therebeyond (away from the roof 110).

Figure 6:
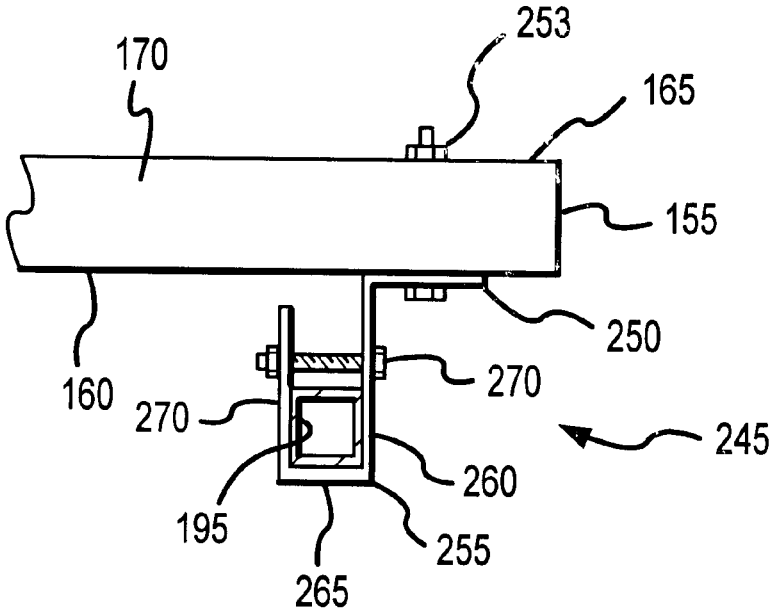
FIG. 6 is a top view of a facia board mounting bracket used by the stanchion of FIG. 3 and in the "unclamped" position.
Figure 7:
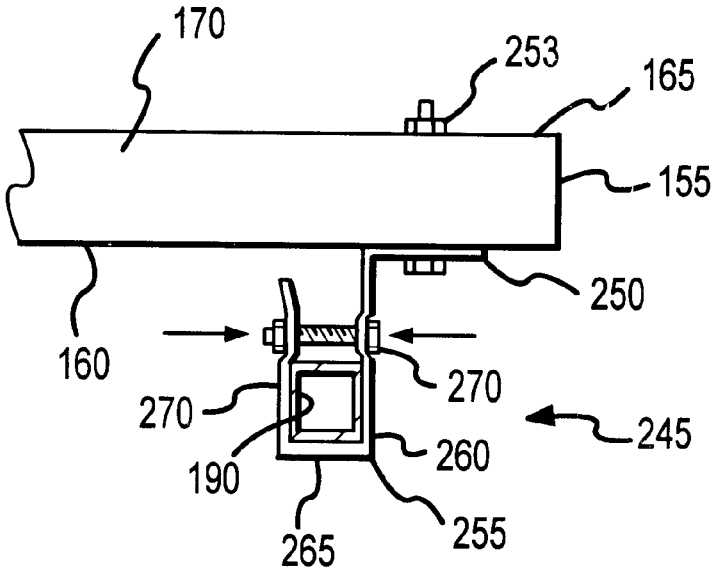
FIG. 7 is a top view of the facia board mounting bracket used by the stanchion of FIG. 3 and in the "clamped" position.

One of the factors which allows the stanchions 195 to be used on roofs 110 having different pitches, different heights for the facia board 155, and different widths for the overhang 115 is the profile or configuration for the stanchions 195 which is again generally J-shaped. Another contributing factor is the particular manner in which the stanchions 195 interconnect with the facia board 155. Referring to FIGS. 6–7, in addition to the FIGS. 2–5 as already discussed, each facia board mounting bracket 245 includes a substantially planar mounting section 250 which is disposed in abutting relation with the first facia board side surface 160. One or more holes are provided in the mounting section 250 for the noted fasteners 253. Each faciaboard mounting bracket 245 further includes a generally U-shaped clamping section 255.

Figure 8:
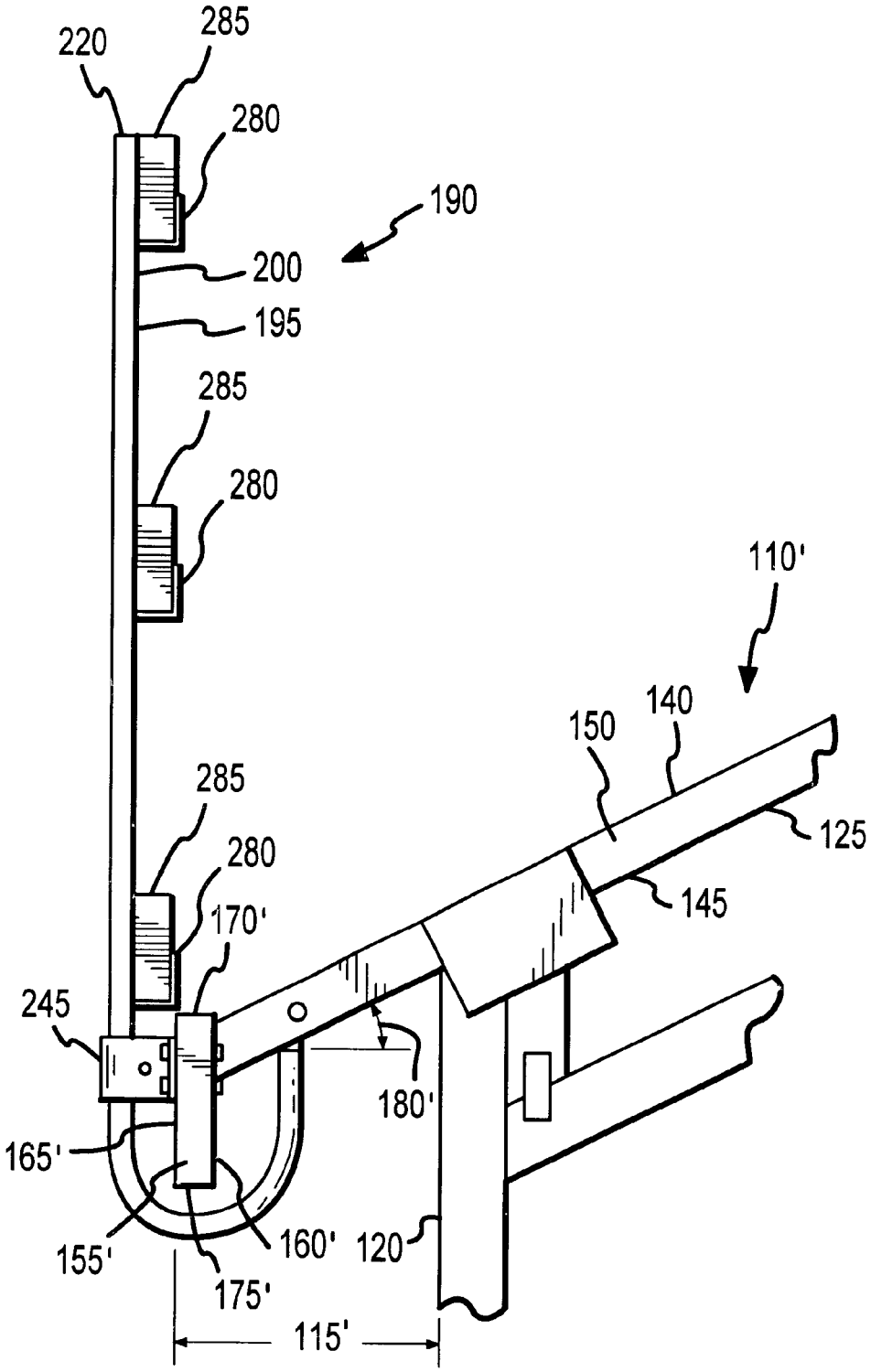
FIG. 8 is the same view of the fall protection system presented in FIG. 3, but on a roof having a different pitch and facia board height.

More specifically, a first section 260 extends at least substantially perpendicularly away from the mounting section 250, a second section 265 interconnects with this first section 260 and is disposed at least substantially perpendicularly thereto, and the third section 270 interconnects with this second section 265 and is disposed at least substantially perpendicularly thereto. The third section 270 is shorter than the first section 260 such that the third section 270 does not extend entirely back to the first facia board side surface 160. A hole extends through each of the first section 260 and the third section 270 such that an appropriate fastener 275 may extend therebetween (e.g., a threaded bolt with an appropriate head or the like on one end thereof and with a nut on its opposite end). The first stanchion section 200 slides through the clamping section 255 of the facia board mounting bracket 245. When it is desired to fix the position of the stanchion 195 relative to the facia board mounting bracket 245, the fastener 275 is "activated" (e.g., threading the nut further onto the bolt) to move or draw the first section 260 and the third section 270 toward each other so as to compressively retain the first stanchion section 200 therewithin. Based upon this type of interconnection, the first stanchion section 200 may be slid relative to the facia board mounting bracket 245 so as to engage the second stanchion end 225 against the second rafter edge surface 145 of one of the rafters 125. Changes in the pitch of the roof 110 or the height of the facia board 155 thereby only affect the actual distance which the first stanchion end 220 is disposed above the roof 110. Other ways of fixing the facia board mounting bracket 245 to the stanchion 195 may be used, such as by using a set screw(s) or the like (e.g., having an encircling collar on the facia board mounting bracket 245 through which the stanchion 195 extends, and having at least one set screw extending into this collar). What is important is the ability of the relative positioning of the stanchion 195 and facia board mounting bracket 245 to be changed and then fixed if it is desired to have a rooftop fall protection device which may be used with a variety of roof pitches and/or heights for facia boards. In this regard, FIG. 8 illustrates the rooftop fall protection device 190 mounted on a roof 110 having a different pitch, overhang, and facia board height than that presented in FIG. 3 (the "prime" designation being used to show structure which corresponds with that illustrated in FIG. 3, but differs in some respect therefrom).

Figure 9:
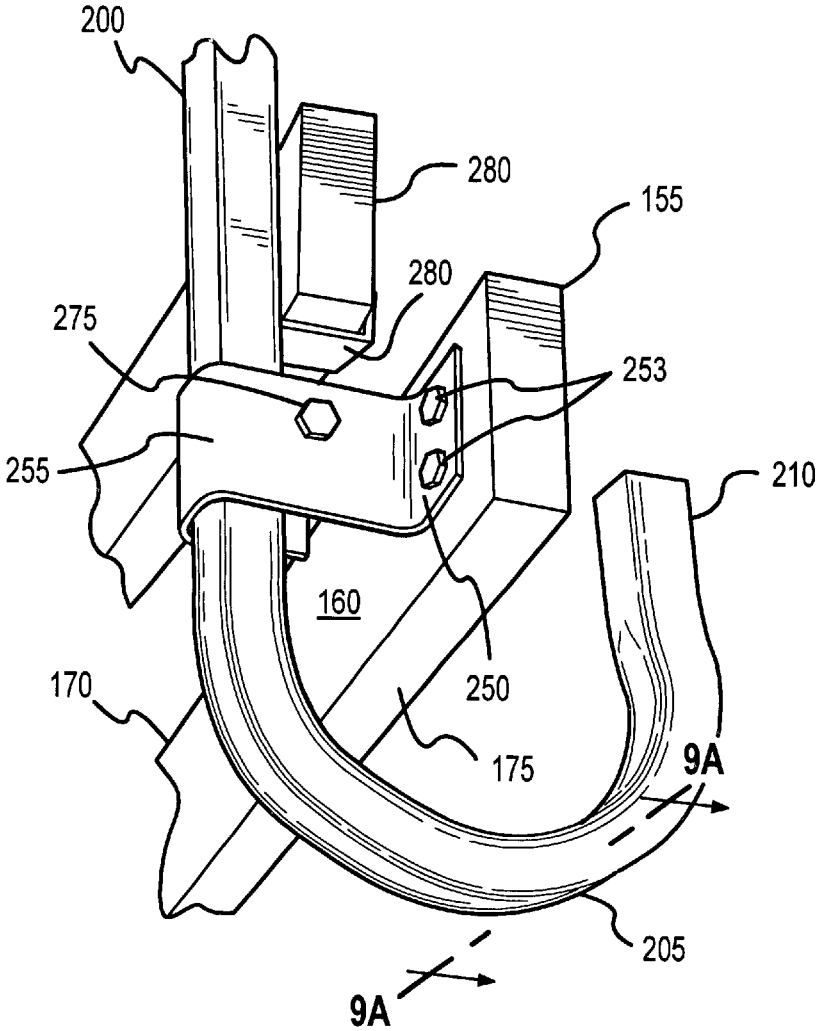
FIG. 9 is a perspective view of the lower portion of the stanchion illustrated in FIG. 3.
Figure 9A:
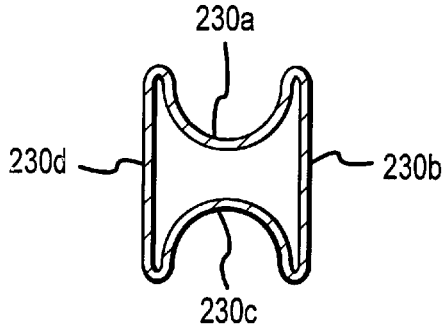
FIG. 9A is a cross-sectional view take a long line 9A—9A in FIG. 9.

Although the stanchions 195 have been described as been of multiple sections, preferably each stanchion 195 is integrally formed or of a one-piece construction (i.e., no joint between any of the first stanchion section 200, the second stanchion section 205, or the third stanchion section 210). Square tubing may be used to provide the profile for the stanchion 195 discussed above. In one embodiment, 1.5 inch square tubing defined by sides 230*a–d* is used for the stanchions 195 and which has a wall thickness of about 14 gauge. When this tubing is bent into the desired profile for the stanchions 195, "laterally extending" radii or curves may be formed into the sides 230*a* and 230*d* of the tubing which is believed to further increase the strength of the stanchions 195. The curvature is illustrated in FIGS. 9 and 9A.

Figure 10A:
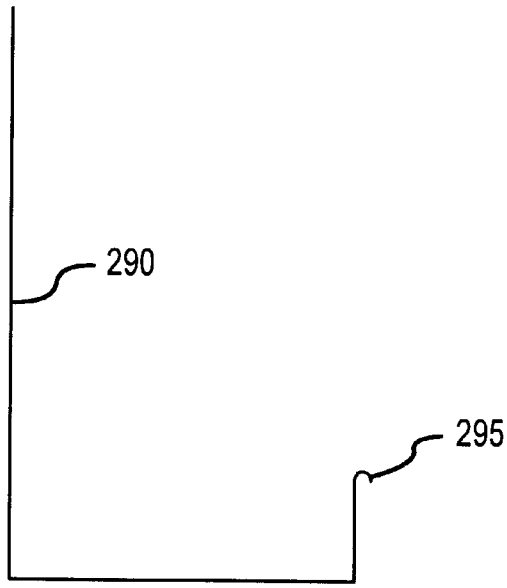
FIGS. 10A–B are alternate configurations for stanchions which may be incorporated into the rooftop fall protection system illustrated in FIG. 2.
Figure 10B:
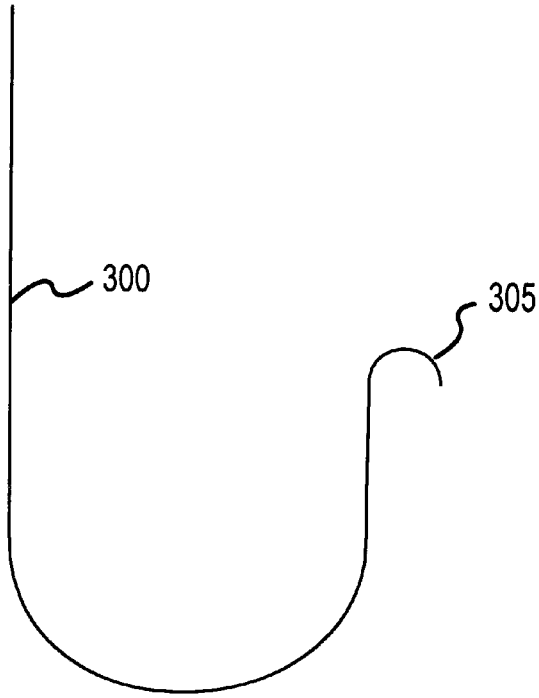

The stanchions 195 discussed above are the preferred stanchion configuration for the rooftop fall protection system 190. However, other configurations could be used which would serve the objective of attaching to the facia board 155 in the above-noted manner and yet still engaging the second rafter edge surface 145 of one of the rafters 125. FIG. 10A illustrates one such stanchion 290 having an end 295 which would engage the second rafter edge surface 145 and which could be attached to the facia board 155 with the above-described type of facia board mounting bracket 245. The stanchion 300 of FIG. 10B illustrates that it need not be an end that engages the second rafter edge surface 145, but instead may be an intermediate portion of the stanchion 300, such as a convexly-shaped rafter engaging section 305. Attachment of the stanchion 300 to the facia board 155 could also be affected through the noted facia board mounting bracket 245. Although these alternative configurations may be used to interconnect with the first facia board side surface 160 and the second rafter edge surface 145, the configuration of the stanchion 195 is preferred from a strength standpoint, an ease of manufacturing standpoint, and an ease of use standpoint.

The foregoing description of the present invention has been presented for purposes of illustration and description. Furthermore, the description is not intended to limit the invention to the form disclosed herein. Consequently, variations and modifications commensurate with the above teachings, and skill and knowledge of the relevant art, are within the scope of the present invention. The embodiments described hereinabove are further intended to explain best modes known of practicing the invention and to enable others skilled in the art to utilize the invention in such, or other embodiments and with various modifications required by the particular application(s) or use(s) of the present invention. It is intended that the appended claims be construed to include alternative embodiments to the extent permitted by the prior art.

What is claimed is:

1. A rooftop fall protection system, comprising:

a roof that comprises a facia board and a plurality of rafters, wherein said facia board comprises first and second oppositely disposed facia board side surfaces, wherein each of said plurality of rafters comprises a first rafter end which engages said second facia board side surface, extends upwardly and away from said facia board at a first angle relative to a horizontal reference plane, comprises a first rafter edge surface on which roofing materials may be installed, and further comprises a second rafter edge surface which is disposed directly opposite said first rafter edge surface, and wherein said facia board is attached to each of said plurality of rafters;

a stanchion comprising means for engaging said second rafter edge surface of one of said plurality of rafters and means for extending vertically beyond said facia board, wherein said means for engaging said second rafter edge surface and said means for extending vertically beyond said facia board are positioned on opposite sides of said facia board;

means for detachably fixing said stanchion to said first facia board side surface, wherein said means for detachably fixing comprises a mounting bracket that in turn comprises an aperture through which said means for extending vertically beyond said facia board slidably extends, wherein slidably mounting said mounting bracket on said means for extending vertically beyond said facia board accounts for a magnitude of said first angle of said plurality of rafters by allowing for a movement of an entirety of said stanchion relative to said mounting bracket to in turn provide for engagement between said means for engaging said second rafter edge surface and said second rafter edge surface, as well as a positioning of said mounting bracket in alignment with said facia board when installing said stanchion on said roof; and means for mounting at least one cross-member to said means for extending vertically beyond said facia board.

2. A system, as claimed in claim 1, wherein:

said mounting bracket comprises an at least substantially U-shaped section through which a portion of said means for extending vertically beyond said facia board slidably extends and which in turn comprises a pair of side sections and an interconnecting end section, said mounting bracket further comprising means for drawing said pair of side sections toward each other, said portion of said means for extending vertically beyond said facia board being disposed between said end section and said means for drawing.

3. A system, as claimed in claim 2, wherein:

said means for drawing comprises a threaded bolt and a nut.

4. A system, as claimed in claim 1, wherein:

said means for detachably fixing comprises at least one engagement member which extends through said mounting bracket and into said facia board, and means for fixing a portion of said means for extending vertically beyond said facia board to said mounting bracket.

5. A system, as claimed in claim 1, wherein:

said means for engaging said second rafter edge surface comprises a first free end on a first end portion of said stanchion.

6. A system, as claimed in claim 5, wherein:

said stanchion comprises a second free end, wherein when said stanchion is fixed to said facia board, said second free end is disposed at a higher elevation than said first free end.

7. A system, as claimed in claim 5, wherein:

said stanchion further comprises a rafter mounting bracket attached to said first end portion which interfaces with a first rafter side surface of one of said plurality of rafters which extends between and interconnects said first and second rafter edge surfaces of said one of said plurality of rafters, and at least one attachment member which extends through said rafter mounting bracket and at least into said one of said plurality of rafters.

8. A system, as claimed in claim 1, wherein:

said mounting bracket comprises an at least generally U-shaped pocket that defines said aperture.

9. A system, as claimed in claim 1, wherein:

said stanchion comprises a generally J-shaped, integrally formed support.

10. A system, as claimed in claim 1, wherein:

said stanchion comprises first, second, and third stanchion sections which are integrally formed such that there is no joint therebetween, and wherein said stanchion further comprises first and second free ends, wherein said second stanchion section is at least generally semicircular, wherein said first stanchion section extends away from said first free end at least generally in a first direction to one side of said second stanchion section, and wherein said third stanchion section extends away from an opposite side of said second stanchion section in a second direction which is at least generally opposite said first direction to said second free end.

11. A system, as claimed in claim 10, wherein:

a portion of said second stanchion section disposed under said facia board is defined by a radius of about 3.75 inches.

12. A system, as claimed in claim 10, wherein:

when said stanchion is fixed to said facia board, said first and second ends are vertically displaced with said first end being disposed at a higher elevation than said second end, and with said first end extending at least about 39 inches vertically beyond an upper surface of said facia board.

13. A system, as claimed in claim 1, wherein:

said at least one cross-member comprises a two-by-four board.

14. A system, as claimed in claim 1, further comprising:

means for allowing said stanchion to be used with any said facia board having a height for said first facia board side surface which is no more than about 10 inches and for any pitch of said rafters which is within a range from about 0 to about 12, all while maintaining a portion of said stanchion section on which said means for mounting are located in an at least substantially perpendicular orientation relative to a horizontal reference plane.

15. A rooftop fall protection system attachable to a roof, said roof comprising a facia board and a plurality of rafters, wherein said facia board comprises first and second oppositely disposed facia board side surfaces, wherein each of said plurality of rafters comprises a first rafter end which engages said second facia board side surface, extends upwardly and away from said facia board at a first angle relative to a horizontal reference plane, comprises a first rafter edge surface on which roofing materials maybe installed, and comprises a second rafter edge surface which is disposed directly opposite said first rafter edge surface, and wherein said facia board is attached to each of said plurality of rafters, wherein said rooftop fall protection system comprises:

a stanchion comprising first, second, and third stanchion sections, wherein said first and third stanchion sections are maintained in spaced relation and interconnected by said second stanchion section, wherein said first stanchion section extends upwardly from said second stanchion section further than said third stanchion section, and wherein said stanchion further comprises a second rafter edge surface engaging section;

a facia board mounting bracket interconnected with said stanchion, wherein when said stanchion is mounted on said first facia board side surface via said facia board mounting bracket, said first stanchion section extends at least upwardly relative to said plurality of rafters on a side of said facia board towards which said first facia board side surface projects, said second stanchion section is disposed below said facia board, said third stanchion section extends upwardly relative to said plurality of rafters on a side of said facia board towards which said second facia board side surface projects, and said second rafter edge surface engaging section engages a portion of said second rafter edge surface of one of said plurality of rafters, wherein said facia board mounting bracket comprises an at least substantially U-shaped section through which said first stanchion section slidably extends and which in turn comprises a pair of side sections and an interconnecting end section, said facia board mounting bracket further comprising means for drawing said pair of side sections toward each other, wherein a portion of said first stanchion section is disposed between said end section and said means for drawing; and a plurality of cross-member mounts interconnected with and vertically spaced along said first stanchion section.

16. A system, as claimed in claim 15, wherein:

said first, second, and third stanchion sections are integrally formed such that there is no joint therebetween.

17. A system, as claimed in claim 15, wherein:

said stanchion further comprises first and second free ends, wherein said first free end is an upper extreme of said first stanchion section and said second free end is said second rafter edge surface engaging section.

18. A system, as claimed in claim 15, wherein:

said second stanchion section is semi-circular, wherein said first stanchion section extends from one side of said second stanchion section and said third stanchion section extends from an opposite side of said second stanchion section.

19. A system, as claimed in claim 18, wherein:

said second stanchion section is defined by a radius of about 3.75 inches.

20. A system, as claimed in claim 15, wherein:

said first, second, and third stanchion sections define a generally J-shaped configuration.

21. A system, as claimed in claim 15, further comprising:

a rafter mounting bracket attached to said third stanchion section which interfaces with a first rafter side surface of one of said plurality of rafters which extends between and interconnects said first and second rafter edge surfaces of said one of said plurality of rafters; and at least one attachment member which extends through said rafter mounting bracket end at least into said one of said plurality of rafters.

22. A system, as claimed in claim 15, wherein:

said plurality of cross-member mounts comprises at least generally U-shaped pocket.

23. A system, as claimed in claim 15, further comprising:

means for allowing said stanchion to be used with any said facia board having a height for said first facia board side surface which is no more than about 10 inches and for any pitch of said rafters which is within a range from about 0 to about 12, all while maintaining said first stanchion section in an at least substantially perpendicular orientation relative to a horizontal reference plane.

24. A system, as claimed in claim 15, wherein:

said means for drawing comprises a threaded bolt and a nut.

25. A system, as claimed in claim 15, wherein:

said faciaboard mounting bracket comprises at least one engagement member which extends through said mounting bracket and into said facia board, and means for clamping said stanchion to said facia board mounting bracket.

26. A method for protecting personnel on a roof, said roof comprising a facia board and a plurality of rafters, wherein said facia board comprises first and second oppositely disposed facia board side surfaces, wherein each of said plurality of rafters comprises a first rafter end which engages said second facia board side surface, extends upwardly and away from said facia board at a first angle relative to a horizontal reference plane, comprises a first rafter edge surface on which roofing materials may be installed, and comprises a second rafter edge surface which is disposed directly opposite said first rafter edge surface, and wherein said facia board is attached to each of said plurality of rafters, said method comprising the steps of:

mounting a fall protection system on a first said roof having a first magnitude for said first angle, comprising the steps of:

executing a plurality of installing steps at spaced locations along said facia board, wherein each said installing step comprises:

interconnecting a stanchion with said facia board, wherein said interconnecting step comprises attaching a mounting bracket to said facia board with at least one fastener, wherein said mounting bracket comprises an aperture through which a first portion of said stanchion extends;

engaging a second portion of said stanchion against said second rafter edge surface of one of said plurality of rafters; and sliding said first portion of said stanchion through said aperture in said mounting bracket to move an entirety of said stanchion relative to said mounting bracket, wherein said sliding step allows said mounting bracket to be aligned with said facia board and said second portion of said stanchion to be engaged against said second rafter edge surface, and wherein slidably mounting said mounting bracket on said first portion of said stanchion further accounts for said first magnitude of said first angle; and mounting at least one cross-member between said first portion of each adjacent pair of said stanchions from said executing a plurality of installing steps.

27. A method, as claimed in claim 26, wherein:

said interconnecting step further comprises collapsing said mounting bracket around a portion of said first portion of said stanchion.

28. A method, as claimed in claim 27, wherein:

said mounting bracket comprises a collar through which said first portion of said stanchion extends and which includes said aperture, wherein said collapsing step is executed after said sliding step.

29. A method, as claimed in claim 26, wherein:

said engaging step comprises disposing said first portion of said stanchion outwardly from said first facia board surface, directing a third portion of said stanchion under a lower extreme of said facia board, and directing said entirety of said stanchion upwardly to engage said second portion of said stanchion with said second rafter edge surface of said one of said plurality of rafters.

30. A method, as claimed in claim 26, further comprising the step of:

establishing contact between said second portion of said stanchion and said second rafter edge surface of said one of said plurality of rafters at a location which is about five inches from said second facia board surface measured perpendicularly to said second facia board side surface.

31. A method, as claimed in claim 26, further comprising the step of:

exerting a force on at least one of said cross-members which is at least generally directed away from said roof; and exerting an upwardly directed force on said second rafter edge surface of at least two of said plurality of rafters by said engaging step associated with at least two of said stanchions; and retaining a fixed relative positional relationship between said stanchions and said facia board during said exerting step.

32. A rooftop fall protection system, comprising:

a roof, said roof comprising a facia board and a plurality of rafters, wherein said facia board comprises first and second oppositely disposed facia board side surfaces, wherein each of said plurality of rafters comprises a first rafter end which engages said second facia board side surface, extends upwardly and away from said facia board at a first angle relative to a horizontal reference plane, comprises a first rafter edge surface on which roofing materials may be installed, and comprises a second rafter edge surface which is disposed directly opposite said first rafter edge surface, and wherein said facia board is attached to each of said plurality of rafters;

a stanchion comprising first, second, and third stanchion sections, wherein said first and third stanchion sections are maintained in spaced relation and interconnected by said second stanchion section, wherein said first stanchion section extends upwardly from said second stanchion section further than said third stanchion section, and wherein said stanchion further comprises a second rafter edge surface engaging section;

a facia board mounting bracket interconnected with said stanchion and attached to said first facia board side surface, wherein said first stanchion section extends at least upwardly relative to said plurality of rafters and is disposed on a side of said facia board towards which said first facia board side surface projects, said second stanchion section is disposed below said facia board, said third stanchion section extends upwardly relative to said plurality of rafters on a side of said facia board towards which said second facia board side surface projects, and said second rafter edge surface engaging section engages a portion of said second rafter edge surface of one of said plurality of rafters, wherein said facia board mounting bracket comprises an aperture through which said first stanchion section slidably extends, wherein slidably mounting said facia board mounting bracket on said first stanchion section accounts for a magnitude of said first angle of said plurality of rafters by allowing for a movement of an entirety of said stanchion relative to said facia board mounting bracket to in turn provide for engagement between said second rafter edge surface engaging section and said second rafter edge surface, as well as a positioning of said facia mounting bracket in alignment with said facia board when installing said stanchion on said roof; and a plurality of cross-member mounts interconnected with and vertically spaced along said first stanchion section.

* * * * *

UNITED STATES PATENT AND TRADEMARK OFFICE

CERTIFICATE OF CORRECTION

PATENT NO. : 6,345,689 B1
DATED : February 12, 2002
INVENTOR(S) : McNamee

It is certified that error appears in the above-identified patent and that said Letters Patent is hereby corrected as shown below:

Column 14,
Line 26, please delete “maybe” and insert therefore -- may be --

Column 15,
Line 44, please delete “faciaboard” and insert therefore -- facia board --

Signed and Sealed this

Twenty-seventh Day of August, 2002

*Attest:*

*Attesting Officer*

JAMES E. ROGAN
*Director of the United States Patent and Trademark Office*